US011382485B2

(12) United States Patent
Roy et al.

(10) Patent No.: US 11,382,485 B2
(45) Date of Patent: Jul. 12, 2022

(54) BLADE AND PUMP IMPELLER ASSEMBLY FOR A DISHWASHER

(71) Applicant: WHIRLPOOL CORPORATION, Benton Harbor, MI (US)

(72) Inventors: Pritish Roy, St. Joseph, MI (US); Todd Michael Jozwiak, Benton Harbor, MI (US); John Joseph Burns, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/074,969

(22) Filed: Oct. 20, 2020

(65) Prior Publication Data

US 2021/0030254 A1 Feb. 4, 2021

Related U.S. Application Data

(63) Continuation of application No. 15/689,475, filed on Aug. 29, 2017, now Pat. No. 10,813,527.

(51) Int. Cl.

| | |
|---|---|
| ***A47L 15/42*** | (2006.01) |
| ***A47L 15/06*** | (2006.01) |
| ***F04D 7/04*** | (2006.01) |
| ***A47L 15/00*** | (2006.01) |
| ***F04D 13/06*** | (2006.01) |
| ***F04D 29/18*** | (2006.01) |
| ***F04D 13/08*** | (2006.01) |
| ***F04D 29/70*** | (2006.01) |
| *F04D 29/66* | (2006.01) |

(Continued)

(52) U.S. Cl.

CPC ..... *A47L 15/4227* (2013.01); *A47L 15/001* (2013.01); *A47L 15/06* (2013.01); *A47L 15/4272* (2013.01); *F04D 7/045* (2013.01); *F04D 13/062* (2013.01); *F04D 13/08* (2013.01); *F04D 29/183* (2013.01); *F04D 29/708* (2013.01); *F04D 11/005* (2013.01); *F04D 29/544* (2013.01); *F04D 29/669* (2013.01)

(58) Field of Classification Search

CPC ..... A47L 15/4225; A47L 15/4227; A47L 15/4204; A47L 15/4208; A47L 15/4206; A47L 15/4272; F04D 7/045; F04D 13/062; F04D 13/08

USPC ..... 134/56 D, 111, 186, 115 G, 25.2, 104.4, 134/10

See application file for complete search history.

(56) References Cited

U.S. PATENT DOCUMENTS 2,954,791 A 10/1960 Andrews
4,168,715 A * 9/1979 Spiegel ..... A47L 15/4227 134/104.4

(Continued)

FOREIGN PATENT DOCUMENTS

CN 105662304 A1 6/2016
DE 102015212653 A1 1/2017

*Primary Examiner* — Michael E Barr
*Assistant Examiner* — Thomas Bucci
(74) *Attorney, Agent, or Firm* — McGarry Bair PC

(57) ABSTRACT

A dishwasher comprising a chassis, a tub supported by the chassis and at least partially defining a treating chamber, and a pump that circulates wash liquid in the treating chamber. The pump has an impeller that has a cover, a base with an axis of rotation, and at least one fin protruding from the base. The impeller also has a cap removably coupled to the impeller and at least one blade integrally formed with the cap.

15 Claims, 5 Drawing Sheets

(51) Int. Cl.
*F04D 29/54* (2006.01)
*F04D 11/00* (2006.01)

(56) References Cited

U.S. PATENT DOCUMENTS 4,201,345 A * 5/1980 Ziegler ..... A47L 15/4227 415/121.1
4,228,962 A * 10/1980 Dingier ..... A47L 15/4227 241/92
6,182,674 B1 * 2/2001 Jozwiak ..... A47L 15/4227 134/104.4
6,418,943 B1 * 7/2002 Miller ..... A47L 15/4202 134/104.4
6,454,872 B1 * 9/2002 Miller ..... A47L 15/4227 134/201
6,471,467 B1 * 10/2002 Pagalday ..... A47L 15/4227 134/115 G
7,472,714 B2 * 1/2009 Elick ..... A47L 15/0084 134/115 G
8,366,384 B2 * 2/2013 Sodergard ..... B02C 18/0092 415/121.1
8,382,914 B2 * 2/2013 Jerg ..... A47L 15/4227 134/115 G
9,872,598 B2 * 1/2018 Thayyullathil ..... A47L 15/486
2016/0000295 A1 * 1/2016 Cavallaro ..... B05B 3/0486 134/199

* cited by examiner

BLADE AND PUMP IMPELLER ASSEMBLY FOR A DISHWASHER

CROSS-REFERENCE TO RELATED APPLICATIONS

This application claims priority to and is a continuation of U.S. patent application Ser. No. 15/689,475, filed Aug. 29, 2017, now U.S. Pat. No. 10,813,521, which is incorporated herein by reference in its entirety.

BACKGROUND OF THE INVENTION

Contemporary dishwashers of the household-appliance type have a chamber in which utensils are placed to be washed according to an automatic cycle of operation. Water, alone, or in combination with a treating chemistry, forms a wash liquid that is sprayed onto the utensils during the cycle of operation. The wash liquid is drawn out of the chamber during the cycle of operation via a drain pump. A blade can be provided on the drain or recirculation pump impeller assembly to chop up particles in the wash liquid before they enter the pump.

SUMMARY OF THE INVENTION

The disclosure relates to a dishwasher comprising a chassis, a tub supported by the chassis and at least partially defining a treating chamber, and a recirculation pump for circulating wash liquid in the treating chamber. The dishwasher includes a cylindrical impeller having a base with an axis of rotation and with at least one fin protruding from the base in a radial direction. The base further includes one or more securing elements positioned adjacent the at least one fin and protruding radially from the base. The dishwasher also includes a cap having at least one blade integrally formed with the cap and comprising one or more mounting apertures complimentary in shape to the one or more securing elements on the base for removably coupling the cap to the impeller. The cap press fits over the impeller such that the one or more securing elements engage the one or more mounting apertures in the cap and securely mount the cap to the impeller.

DESCRIPTION OF EMBODIMENTS OF THE INVENTION

Figure 1:
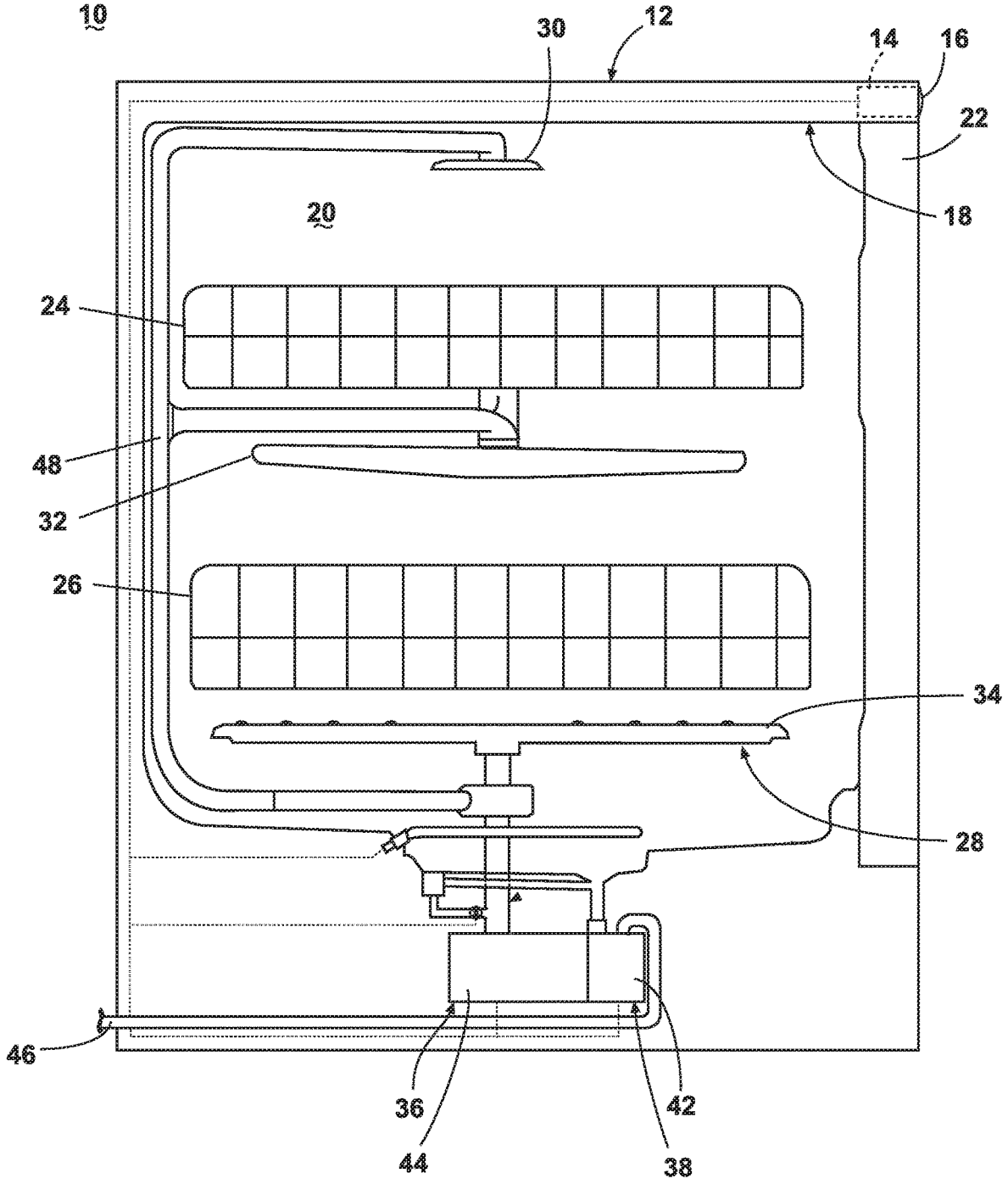
FIG. 1 is a schematic view of a dishwasher in accordance with the disclosure.

FIG. 1, illustrates an automatic dishwasher 10 having a cabinet 12 defining an interior. Depending on whether the dishwasher 10 is a stand-alone or built-in, the cabinet 12 can be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers or drawer-type dishwashers.

A controller 14 can be located within the cabinet 12 and can be operably coupled to various components of the dishwasher 10 to implement one or more cycles of operation. A control panel or user interface 16 can be provided on the dishwasher 10 and coupled to the controller 14. The user interface 16 can include operational controls such as dials, lights, switches, and displays enabling a user to input commands, such as a cycle of operation, to the controller 14 and receive information.

A tub 18 is located within the cabinet 12 and partially defines a treating chamber 20, with an access opening in the form of an open face. A cover, illustrated as a door 22, can be hingedly mounted to the cabinet 12 and can move between an opened position, wherein the user can access the treating chamber 20, and a closed position, as shown in FIG. 1, wherein the door 22 covers or closes the open face of the treating chamber 20.

Utensil holders in the form of upper and lower racks 24, 26 are located within the treating chamber 20 and receive utensils for being treated. The racks 24, 26 are mounted for slidable movement in and out of the treating chamber 20 for ease of loading and unloading. As used in this description, the term "utensil(s)" is intended to be generic to any item, single or plural, that can be treated in the dishwasher 10, including, without limitation: dishes, plates, pots, bowls, pans, glassware, and silverware.

A spray system 28 is provided for spraying wash liquid into the treating chamber 20 and is illustrated in the form of an upper sprayer 30, a mid-level sprayer 32, and a lower sprayer 34. The upper sprayer 30 is located above the upper rack 24 and is illustrated as a fixed spray nozzle that sprays liquid downwardly within the treating chamber 20. The mid-level rotatable sprayer 32 and lower rotatable sprayer 34 are located, respectively, beneath upper rack 24 and lower rack 26 and are illustrated as rotating spray arms. The mid-level spray arm 32 can provide a liquid spray upwardly through the bottom of the upper rack 24. The lower rotatable sprayer 34 can provide a liquid spray upwardly through the bottom of the lower rack 26. The mid-level rotatable sprayer 32 can optionally also provide a liquid spray downwardly onto the lower rack 26, but for purposes of simplification, this will not be illustrated herein.

A liquid recirculation system 36 can recirculate liquid from the treating chamber 20 to the spray system 28. The recirculation system 36 can include any structure in the dishwasher 10 that the wash liquid passes through as it travels from the treating chamber 20 to the spray system 28.

A pump assembly 38 can be included in the recirculation system 36 to pump wash liquid from the treating chamber 20 to the spray system 28. The pump assembly 38 can include both a drain pump 42 and a recirculation pump 44. The drain pump 42 can draw liquid from a lower portion of the tub 18 and pump the liquid out of the dishwasher 10 to a household drain line 46. The recirculation pump 44 can draw liquid from a lower portion of the tub 18 and pump the liquid to the spray system 28 to supply liquid into the treating chamber 20. By way of non-limiting example, the recirculation pump 44 can have a flow rate of 30-50 L/min and output pressures ranging from 150-500 mbar; however, it will be understood that such ranges are exemplary only and an alternative pump having varying attributes can be used.

As illustrated, liquid can be supplied to the mid-level rotatable sprayer 32 and upper sprayer 30 through a supply tube 48, which extends generally rearward from the recirculation pump 44 and upwardly along a rear wall of the tub 18. While the supply tube 48 ultimately supplies liquid to the mid-level rotatable sprayer 32 and upper sprayer 30, it can fluidly communicate with one or more manifold tubes that directly transport liquid to the mid-level rotatable sprayer 32 and upper sprayer 30. The sprayers 30, 32, 34 spray treating chemistry, including only water, onto the dish racks 24, 26 (and hence any utensils positioned thereon) to effect a recirculation of the liquid from the treating chamber 20 to the liquid spray system 28.

A liquid supply (not shown) can be configured to supply water from a household water supply line to the treating chamber 20.

Figure 2:
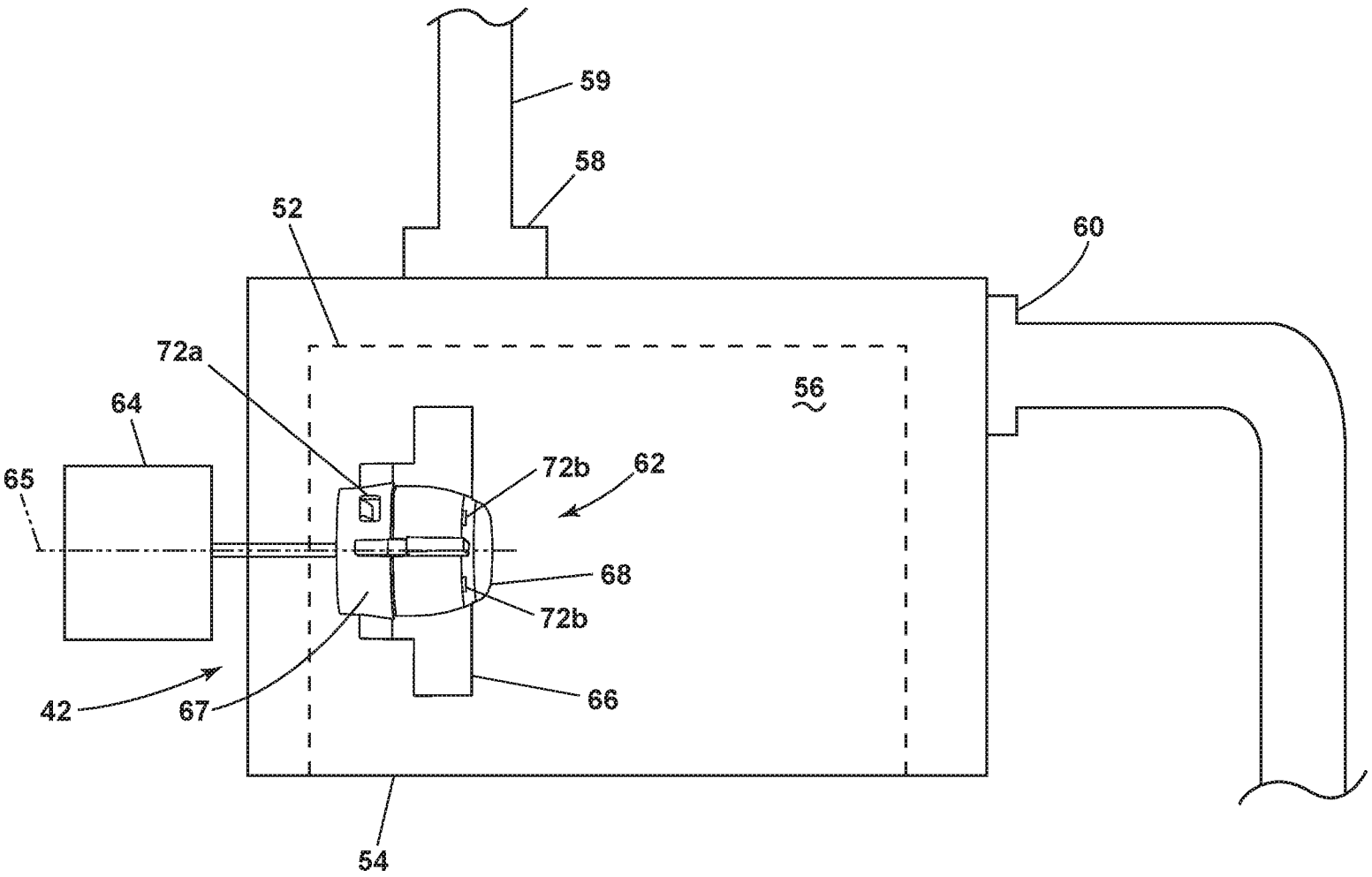
FIG. 2 is a simplified version of a wash system of the dishwasher of FIG. 1.

FIG. 2 illustrates a simplified version of the liquid recirculation system 36 of FIG. 1 illustrating a pump 42 such as a drain pump 42 or recirculation pump 44 associated with the liquid recirculation system 36. As illustrated, the liquid circulation system 36 can comprise a liquid filter system 52 fluidly coupled to the recirculation system 36 and/or the spray system 28 to remove particulates from wash liquid recirculated from the treating chamber 20 to the spray system 28. The liquid filter system 52 can include a housing 54 defining a sump or filter chamber 56. As illustrated, the housing 54 is physically separate from the tub 18 and can provide a mounting structure for either or both the recirculation pump 44 and drain pump 42. The housing 54 has an inlet port 58, which is fluidly coupled to the treating chamber 20 through a conduit 59 and an outlet 60, which is fluidly coupled to one of the drain pump 42 or recirculation pump 44.

The liquid recirculation system 36 can further comprise an impeller 62 located in the housing 54. The impeller 62 can be driven by a motor 64 about an axis of rotation 65. The impeller 62 can be defined by a generally circular base 67, a generally circular or dome shaped cover 68, and one or more fins 66 spaced around the periphery of the base 67 of the impeller 62. The fins 66 can protrude in a radial direction from the base 67 and can be parallel to the base's axis of rotation 65. The components (i.e. base 67, cover 68 and fins 66) of a typical impeller 62 are made from rubber or plastic. In the illustrated embodiment, four generally square fins 66 are equally spaced around the base 67 although the general size, shape, number, material composition, and location of the fins could be varied without limiting the scope of the disclosure.

Figure 3:
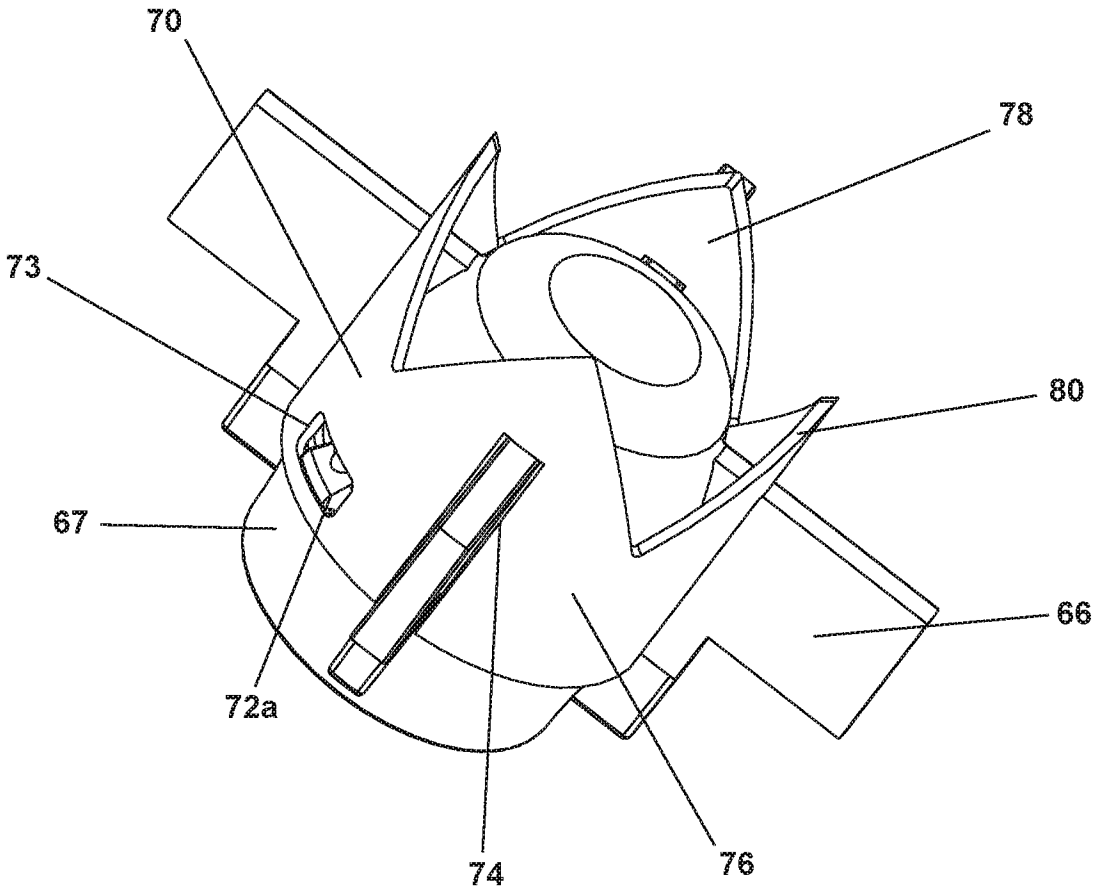
FIG. 3 is a perspective view of a blade on a pump impeller assembly of a dishwasher.

The impeller 62 can further be provided with one or more securing elements 72*a*, 72*b* located in the base 67 or integrally formed in the cover 68 of the impeller 62, respectively, to securely couple cap 70 to the impeller 62 as illustrated in FIG. 3. As illustrated, cap 70 can be provided with a mounting aperture 73 for engaging the securing element 72*a* formed in the base 67 of the impeller 62 for securing the cap 70 to the base 67. The cap 70 can comprise a lower portion 76 comprising a complimentary circular shape to the base 67. The lower portion 76 of the cap 70 can also include one or more cutouts 74 corresponding with the number of fins 66 on the impeller base 67. The lower portion 76 of the cap 70 can mount over the impeller base 67 and the cutouts 74 in the cap 70 can mount over the fins 66.

The cap 70 can also comprise an upper portion 78 defining one or more blades 80. As illustrated, four blades 80 extend around the periphery of the cap 70 and extend above the cover 68 of the impeller 62. The profile of the blades 80 is sinusoidal shaped and each of the blades 80 can have a slightly outwardly arched profile. The cap 70 can made of a plastic or stainless steel. It should be recognized that the general size, shape, number, material composition, and location of the blades 80 and cap 70 could be varied without limiting the scope of the disclosure.

Figure 4:
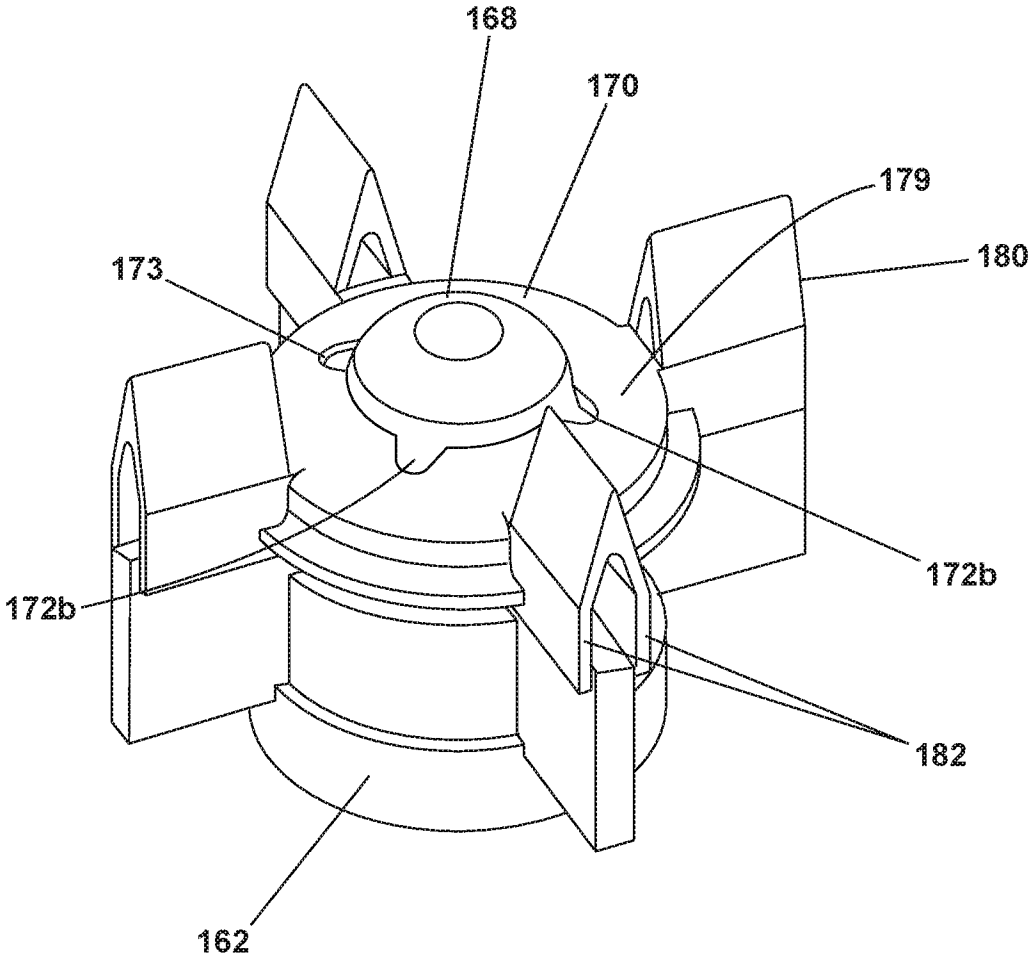
FIG. 4 is a perspective view of a blade on a pump impeller assembly of a dishwasher.

FIG. 4 illustrates an exemplary cap 170 securely mounted on impeller 162. In this illustration, the impeller 162 is substantially identical to the impeller 62 of FIG. 2. In addition, other like parts will be identified with like numerals increased by 100, with it being understood that the description of the like parts is consistent unless otherwise noted.

In this illustration, the impeller 162 can further be provided with one or more securing elements 172*b* located on the cover 168 of the impeller 162 to securely couple cap 170 to the impeller 162. As illustrated, cap 170 can be provided with mounting apertures 173 complimentary to the shape of the securing elements 172*b* formed on the cover 168 of the impeller 162 for securing the cap 170 to the base 167. Cap 170 can be press fit over the impeller cover 168 such that the securing elements 172*b* protude through the apertures in the cap 170. Upon twisting the cap 170, the securing elements 172*b* will contact a top planar surface 179 of the cap 170 and the cap 170 will be axially compressed to the base 167 of impeller 162.

The cap 170 also comprises one or more blades 180. As illustrated, four blades 180 are adjacent to and extend around the periphery of the cap 170 and also extend above the cover 168 of the impeller 162. The blades 180 can be generally parallel and in axial alignment to the fins 166. In addition, one or more of the blades 180 can couple to the one or more fins 166. In more detail, each blade 180 can comprise a pair of legs 182 that are configured to sandwich and engage fin 166. The cap 170 and blades 180 can made of a plastic or rubber or a combination thereof. It should be recognized that the general size, shape, number, material composition, and location of the blades 180 and cap 170 could be varied without limiting the scope of the disclosure.

Figure 5:
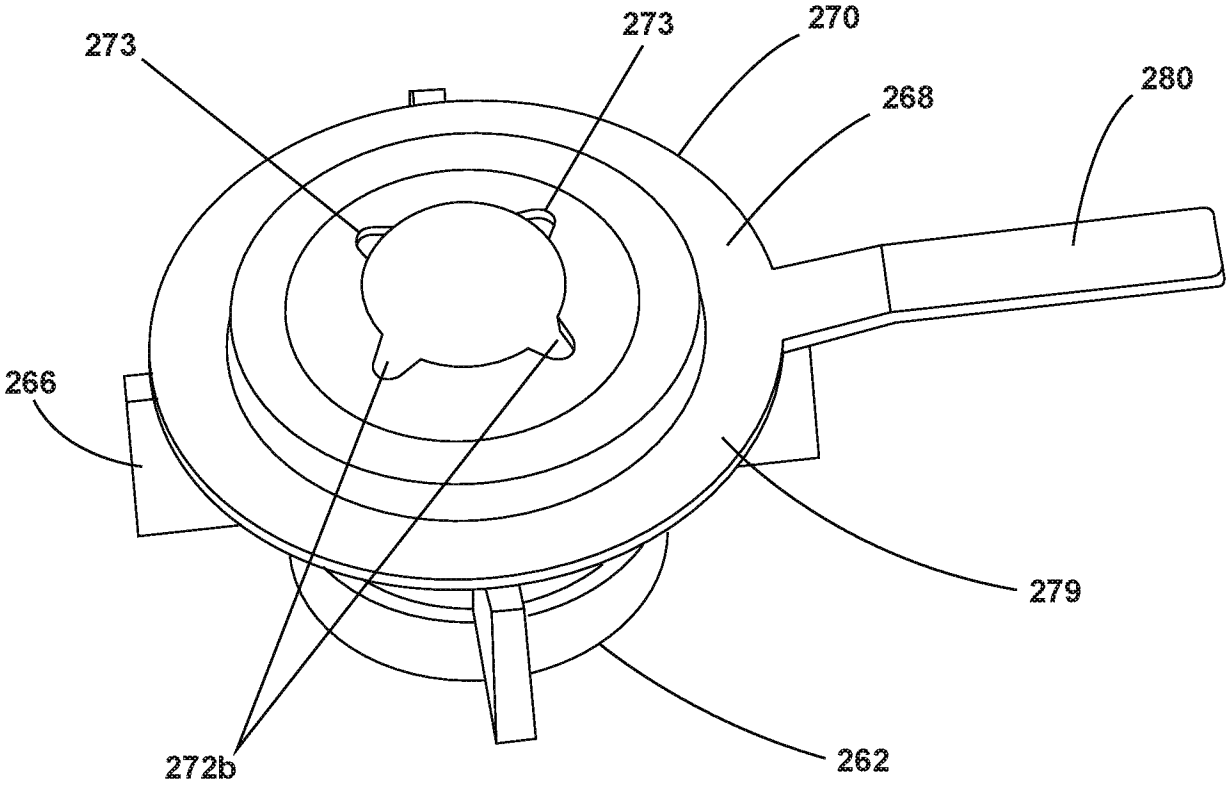
FIG. 5 is a perspective view of a blade on a pump impeller assembly of a dishwasher.

FIG. 5 illustrates an exemplary cap 270 securely mounted on impeller 262. In this illustration, the impeller 262 is substantially identical to the impeller 62 of FIG. 2. In addition, other like parts will be identified with like numerals increased by 200, with it being understood that the description of the like parts is consistent unless otherwise noted.

In this illustration, cap 270 can be securely mounted on impeller 262 in the same manner as cap 170 is mounted on impeller 162. Once again, cap 270 can be provided with mounting apertures 273 complimentary to the shape of the securing elements 272*b* formed on the cover 268 of the impeller 262 for securing the cap 270 to the base 267. The cap 270 can also comprise one or more blades 280. As illustrated, one blade 280 protrudes in a radial direction from a planar top surface 279 and is substantially perpendicular to the at least one fin 266. The blade 280 can also extend radially beyond the fins 266. The cap 270 and blade 280 can made of a plastic or rubber or a combination thereof. It should be recognized that the general size, shape, number, material composition, and location of the blades 280 and cap 270 could be varied without limiting the scope of the disclosure.

In operation it should be recognized that having a blade secured to an impeller on a drain or recirculation pump can help prevent clogging of the impeller. Debris in the wash liquid can cause the impeller to stop rotating and can cause a reduction in drain performance and subsequent wash performance. In the event filters in the sump or housing were to clog, some debris can enter the pump housing. A rotating blade can help chop up and break down any larger debris in the pump housing, thus helping prevent a clogged impeller.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

The invention claimed is:

1. A dishwasher comprising:

a chassis;

a tub supported by the chassis and at least partially defining a treating chamber;

a recirculation pump for circulating wash liquid in the treating chamber comprising;

a cylindrical impeller having a base with an axis of rotation and with at least one fin protruding from the base in a radial direction; the base further comprising one or more securing elements positioned adjacent the at least one fin and protruding radially from the base;

a cylindrical cap having an upper portion comprising at a plurality of blades extending around a periphery of the cap and a profile of the plurality of blades comprising a sinusoidal shape, and wherein each of the plurality of blades has an outwardly arched profile and the plurality of the blades is integrally formed with the cylindrical cap, and, the cylindrical cap further comprises a lower portion comprising one or more mounting apertures complimentary in shape to the one or more securing elements on the base for removably coupling the cap to the impeller;

wherein the cap press fits over the impeller such that the one or more securing elements engage the one or more mounting apertures in the cap and securely mounts the cap to the impeller.

2. The dishwasher of claim 1, wherein at least one blade of the plurality of blades mounts over the at least one fin.

3. The dishwasher of claim 2, wherein the at least one blade of the plurality of blades is axially adjacent to the at least one fin after the cap is secured to the base.

4. The dishwasher of claim 1, wherein the plurality of blades comprises four blades equally spaced around the periphery of the cap.

5. The dishwasher of claim 4, wherein the at least one fin comprises four fins equally spaced around the outer periphery of the base.

6. The dishwasher of claim 5, wherein the four blades mount over and are axially aligned with the four fins.

7. The dishwasher of claim 1, wherein the plurality of blades are made out of stainless steel.

8. The dishwasher of claim 1, wherein the at least one fin is a plurality of fins spaced around the base of the impeller.

9. The dishwasher of claim 8, wherein each of the plurality of fins has a length that extends a length of the base.

10. The dishwasher of claim 1, wherein the at least one fin comprises one of a plastic or rubber.

11. The dishwasher of claim 1, further comprising a motor driving the cap for preventing clogging of the impeller.

12. The dishwasher of claim 1, wherein the one or more securing elements comprises two securing elements.

13. The dishwasher of the claim 12, wherein the two securing elements are spaced on opposite sides of the base.

14. The dishwasher of claim 13, wherein the one or more mounting apertures comprises two mounting apertures spaced on opposite sides of the cap and in alignment with the two securing elements.

15. The dishwasher of claim 14, wherein the two mounting apertures snap fit over the two securing elements.

* * * * *